United States Patent [19]

Campbell et al.

[11] 4,140,504

[45] Feb. 20, 1979

[54] HYDROCARBON GAS PROCESSING

[75] Inventors: Roy E. Campbell; John D. Wilkinson, both of Midland, Tex.

[73] Assignee: The Ortloff Corporation, Midland, Tex.

[21] Appl. No.: 728,964

[22] Filed: Oct. 4, 1976

Related U.S. Application Data

[63] Continuation-in-part of Ser. No. 712,826, Aug. 9, 1976, abandoned.

[51] Int. Cl.[2] ..... F25J 3/04

[52] U.S. Cl. ..... 62/28; 62/38; 62/23

[58] Field of Search ..... 62/38, 39, 28, 27, 23

[56] References Cited

U.S. PATENT DOCUMENTS

| | | | |
|---|---|---|---|
| 2,903,858 | 9/1959 | Bocquet | 62/38 |
| 2,915,880 | 12/1959 | Schuftan et al. | 62/38 |
| 3,277,655 | 10/1966 | Geist et al. | 62/39 |
| 3,292,380 | 12/1966 | Bucklin | 62/38 |
| 3,490,246 | 1/1970 | Becker | 62/38 |

*Primary Examiner*—Norman Yudkoff

*Attorney, Agent, or Firm*—Brumbaugh, Graves, Donohue & Raymond

[57] ABSTRACT

A process for separating hydrocarbon gases is described for the recovery of gases such as ethane and heavier hydrocarbons from natural gas streams or similar refinery or process streams. In the process described, the gas to be separated is cooled at a high pressure to produce partial condensation, and the vapor and liquid portions are separated. Liquid from the partial condensation is further cooled and then expanded to a lower pressure. At the lower pressure, the liquid is supplied to a distillation column, wherein it is separated into fractions. The vapor portion is work-expanded to the operating pressure of the distillation column and supplied to the distillation column below the feed point of the expanded liquid portion. The operating efficiency of the process is improved by turning back at least part of the vapor portion and warming it by heat exchange against incoming feed before it is work-expanded. By thus warming the vapor, more work and refrigeration can be recovered in the work expansion machine.

16 Claims, 8 Drawing Figures

(PRIOR ART, FIG. 2)

(PROCESS OF EX. I, FIG. 4)

HYDROCARBON GAS PROCESSING

This is a continuation in part of our copending application Ser. No. 712,826, filed Aug. 9, 1976 now abandoned.

This invention relates to the processing of gas streams containing hydrocarbons and other gases of similar volatility to remove desired condensible fractions. In particular, the invention is concerned with processing of gas streams such as natural gas, synthetic gas and refinery gas streams to recover most of the propane and a major portion of the ethane content thereof, together with substantially all of the heavier hydrocarbon content of the gas.

Gas streams containing hydrocarbons and other gases of similar volatility which may be processed according to the present invention include natural gas, synthetic gas streams obtained from other hydrocarbon materials such as coal, crude oil, naphtha, oil shale, tar sands, and lignite. Natural gas typically has a major proportion of methane and ethane (i.e., the combined $C_1$ and $C_2$ fractions constitute at least 50% of the gas on a molar bases). There may also be lesser amounts of the relatively heavier hydrocarbons such as propane, butanes, pentanes, and the like as well as $H_2$, $N_2$, $CO_2$ and other gases. A typical analysis of a natural gas stream to be processed in accordance with the invention would be, in approximate mol %, 80% methane, 10% ethane, 5% propane, 0.5% iso-butane, 1.5% normal butane, 0.25% iso-pentane, 0.25% normal pentane, 0.5% hexane plus, with the balance made up of nitrogen and carbon dioxide. Sulfur-containing gases are also often found in natural gas.

Recent substantial increases in the market for the ethane and propane components of natural gas has provided demand for processes yielding higher recovery levels of these products. Available processes for separating these materials include those based upon cooling and refrigeration of gas, oil absorption, refrigerated oil absorption, and the more recent cryogenic processes utilizing the principle of gas expansion through a mechanical device to produce power while simultaneously extracting heat from the system. Depending upon the pressure of the gas source, the richness (ethane and heavier hydrocarbons content) of the gas and the desired end products, each of these prior art processes or a combination thereof may be employed.

The cryogenic expansion type recovery process is now generally preferred for ethane recovery because it provides maximum simplicity with ease of start up, operating flexibility, good efficiency, safety, and good reliability. U.S. Pat. Nos. 3,360,944, 3,292,380, and 3,292,381 describe relevant processes.

In a typical cryogenic expansion type recovery process a feed gas stream under pressure is cooled by heat exchange with other streams of the process and/or external sources of cooling such as a propane compression-refrigeration system. As the gas is cooled, liquids are condensed and are collected in one or more separators as a high-pressure liquid feed containing most of the desired $C_2$+ components. The high pressure liquid feed is then expanded to a lower pressure. The vaporization occurring during expansion of the liquid results in further cooling of the remaining portion of the liquid. The cooled stream comprising a mixture of liquid and vapor is demethanized in a demethanizer column. The demethanizer is a fractionating column in which the expansion-cooled stream is fractionated to separate residual methane, nitrogen and other volatile gases as overhead vapor from the desired products of ethane, propane and heavier components as bottom product.

If the feed stream is not totally condensed, typically it is not, the vapor remaining from this partial condensation is expanded to a lower pressure. Additional liquids are condensed as a result of the further cooling of the stream during expansion. The pressure after the expansion is usually the same pressure at which the demethanizer is operated. Liquids thus obtained are also supplied as a feed to the demethanizer. Typically, remaining vapor and the demethanizer overhead vapor are combined as the residual methane product gas.

In the ideal operation of such a separation process the vapors leaving the process will contain substantially all of the methane found in the feed gas to the recovery plant, and substantially no hydrocarbons equivalent to ethane or heavier components. The bottoms fraction leaving the demethanizer will contain substantially all of the heavier components and essentially no methane. In practice, however, this ideal situation is not obtained for the reason that the conventional demethanizer is operated largely as a stripping column. The methane product in the process, therefore, typically comprises vapors leaving the top fractionation stage of the column together with vapors not subjected to any rectification step. Substantial losses of ethane occur because the vapors discharged from the low temperature separation steps contain ethane and heavier components which could be recovered if those vapors could be brought to lower temperatures or if they were brought in contact with a significant quantity of relatively heavy hydrocarbons, for example $C_3$ and heavier, capable of absorbing the ethane.

As described in co-pending applications, Ser. No. 698,065 filed June 21, 1976, Ser. No. 712,825 filed Aug. 9, 1976, and Ser. No. 728,962 filed Oct. 4, 1976, filed concurrently herewith, of Campbell, Wilkinson and Rambo, improved ethane recovery is achieved by pre-cooling the condensed high-pressure liquid prior to expansion. Such pre-cooling will reduce the temperature of the flash-expanded liquid feed supplied to the demethanizer and thus improve ethane recovery. Moreover, as described in said applications, by pre-cooling the high pressure liquid feed, the temperature of the expanded liquid may be sufficiently reduced that it can be used as top column feed in the demethanizer, while the expanded vapor is supplied to the demethanizer at a feed point intermediate the top feed and column bottom. This variation permits recovery of ethane contained in the expanded vapor which would otherwise be lost.

It will be obvious that to supply external refrigeration at this stage of the process is difficult because of the extremely low temperatures encountered. In typical demethanizer operations the expanded liquid and vapor feeds are typically at temperatures in the order of −120° F. to −190° F. Accordingly, pre-cooling of the condensed high pressure liquid stream feed can best be achieved by heat exchange of the condensed high pressure liquid stream feed with streams derived within the process as described in co-pending applications Ser. No. 698,065, Ser. No. 712,825, and Ser. No. 728,962.

As already indicated, in modern gas processing plants the vapors remaining from partial condensation of the feed gas are usually expanded to the operating pressure of the demethanizer column in a turbo-expander and, prior to the invention disclosed in co-pending applications Ser. No. 698,065, Ser. No. 712,825, and Ser. No. 728,962 supplied to the demethanizer as the top feed. A turbo-expander is a machine which extracts useful work from the gas during expansion by expanding that gas in a substantially isentropic fashion. Such a work expansion has two advantages. First, it permits cooling the vapor portion to the coldest practicable temperature. Attainment of such cold temperatures is important in the top feed to the demethanizer to provide the most complete recovery of $C_2+$ components from the incoming feed gas. Second, the useful work recovered by isentropic expansion can be used to supply a portion of the compression requirements ordinarily required in the process.

As explained in the co-pending applications of Campbell, Wilkinson and Rambo, Ser. No. 698,065, Ser. No. 712,825, and Ser. No. 728,962, the liquids recovered from partial condensation of the feed gas may be cooled below their bubble point, and if this is done, upon flash expansion it is possible to achieve flash-expanded temperatures of that sub-cooled liquid even below the temperature achieved by work-expansion of the vapors from partial condensation. Where such low temperatures are achieved in the flash-expanded liquids, it is then usually preferable to supply that flash-expanded liquid as the column feed at a point above the feed point of the work-expanded vapor recovered from partial condensation. The flash-expanded temperature of the sub-cooled liquid may be further reduced by combining the liquid with a process gas stream which reduces the bubble point of the sub-cooled liquid as explained in our co-pending application, Ser. No. 712,771 filed Aug. 9, 1976, and Ser. No. 728,962 filed Oct. 4, 1976, filed concurrently herewith.

In accordance with the present invention, it has now been discovered that when an alternate process stream is available to maintain top column condition, some (or all) of the vapors separated upon partial condensation may be turned back and reheated prior to expansion. The reheating of the turn-back vapor stream can provide refrigeration to an earlier process stage.

For example, when the liquid portion of the partially condensed feed gas is subcooled and employed as the top column feed, as explained in the aforementioned co-pending applications, Ser. No. 698,065, Ser. No. 712,825, and Ser. No. 728,962, the expanded, cooled liquid may be able to maintain a cold top column temperature, and the vapors from work expansion of the partially condensed feed gas can be employed as a feed to the demethanizing column at an intermediate position. In this event, it is advantageous to turn back some or all of those vapors and warm them prior to work expansion. The mechanical work recovered and refrigeration developed in the expansion machine is greater as a result of expansion beginning at a warmer temperature. Because of the importance of heat economy in natural gas processing, it is generally preferable to turn back the vapors from partial condensation in accordance with the present invention and employ those vapors in a heat exchange relation with all or a portion of the incoming feed stream. This provides the desired warming of the turned-back vapor portion. In this manner vapor turn-back can reduce the need for external refrigeration which might otherwise be required, or alternately could be used to increase recovery of liquid products.

The present invention will be better understood by reference to the following drawings and examples, in which.

Figure 3:
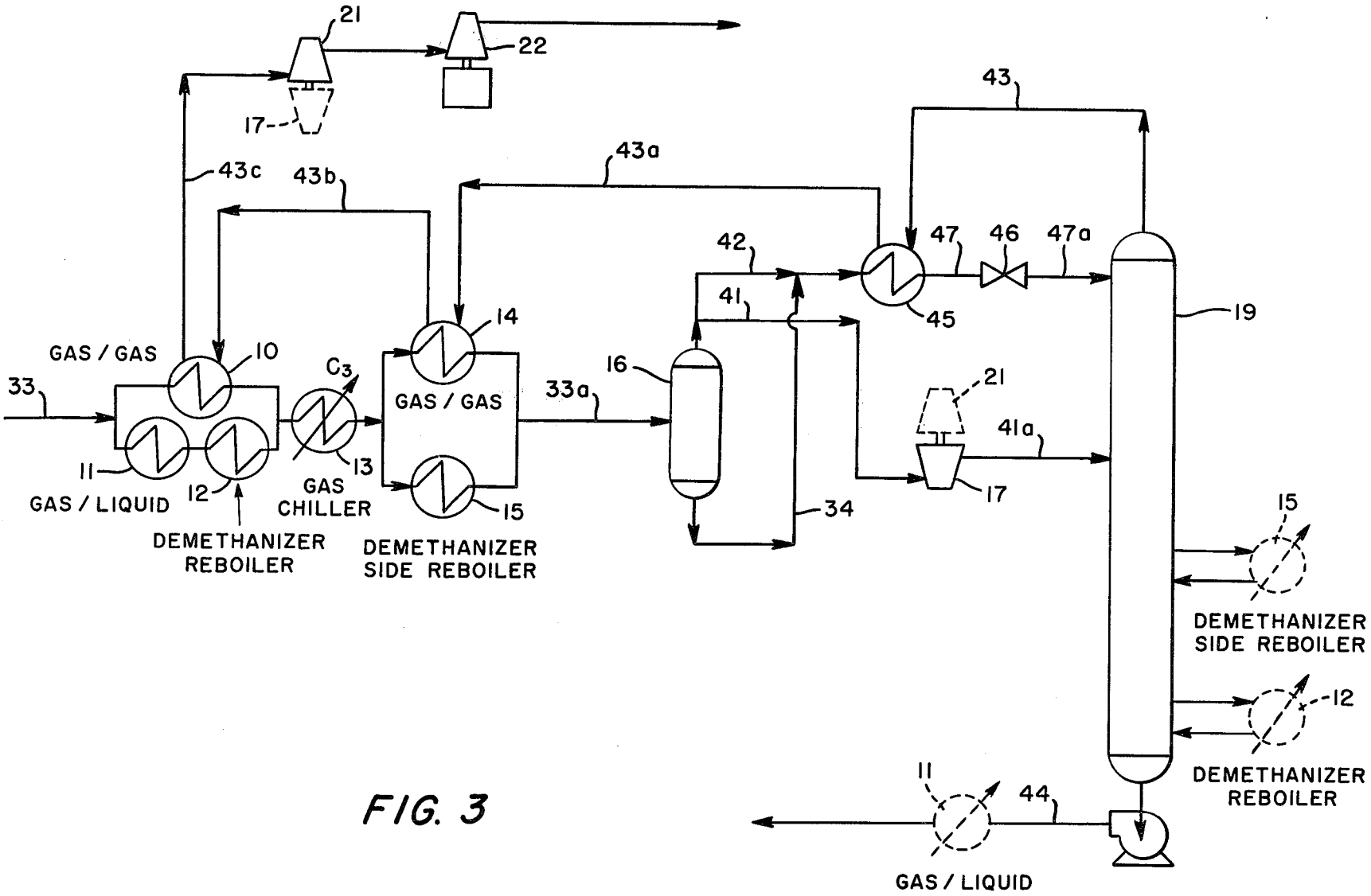
Figure 4:
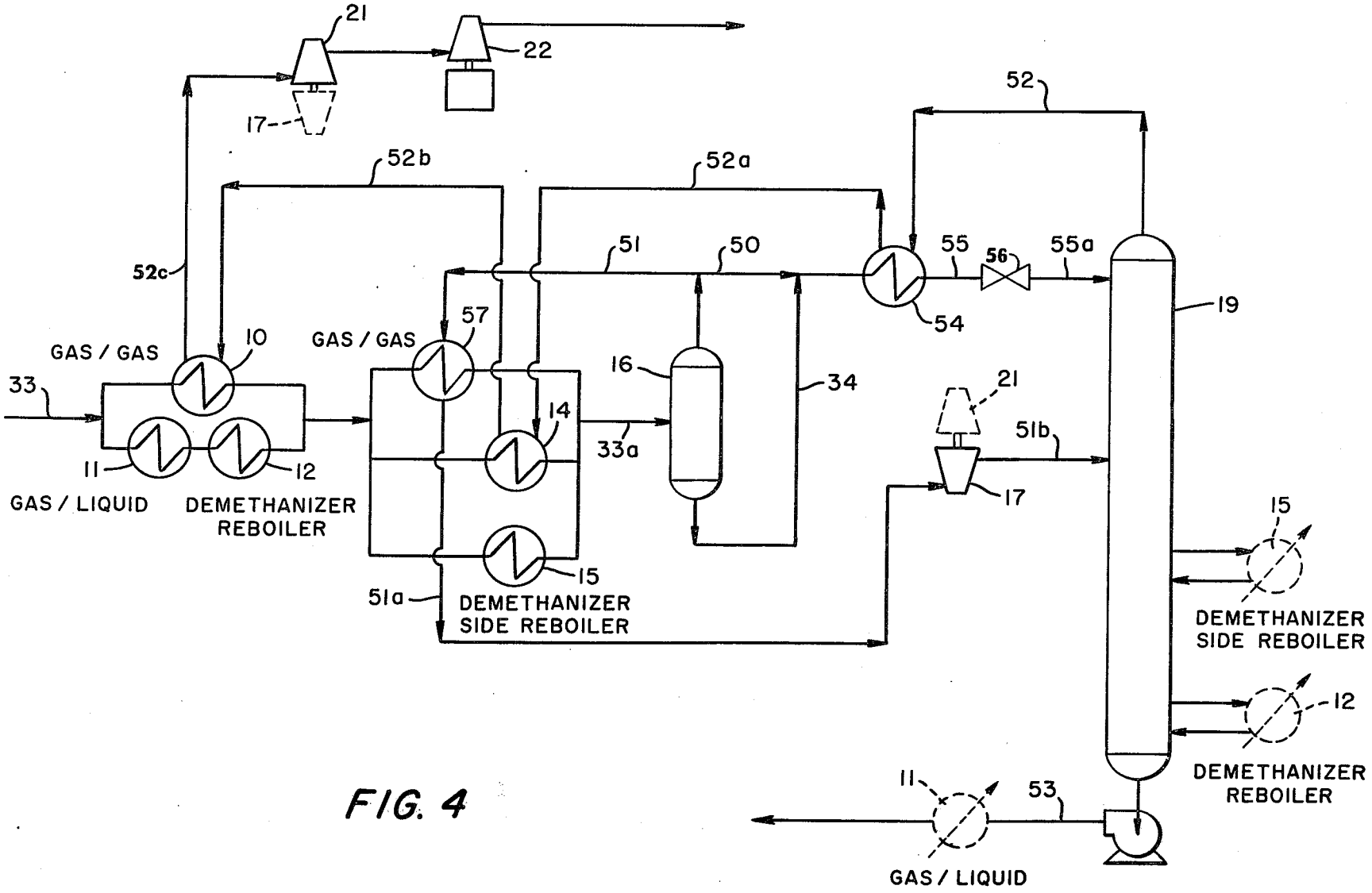

FIG. 3 is a flow diagram of a gas processing plant embodying the invention forming the subject matter of said applications Ser. No. 698,065, Ser. No. 712,825, Ser. No. 728,962, Ser. No. 712,771, and Ser. No. 728,963 which is employed as a base case;

FIG. 4 is a flow diagram of a gas processing plant in accordance with the present invention.

Figure 5:
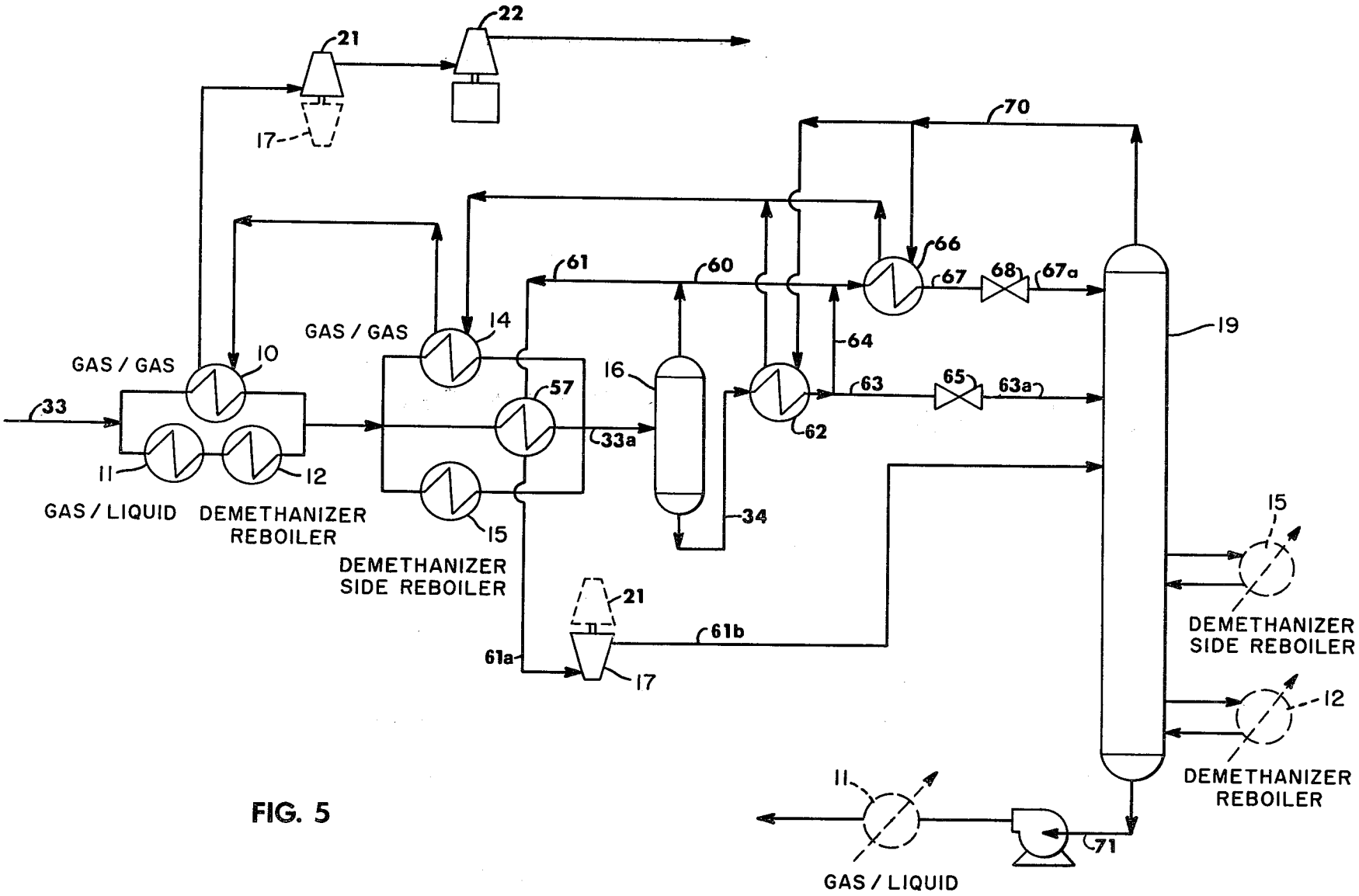

FIG. 5 is a variation of the present invention in which a portion of the condensed high-pressure liquid feed is sub-cooled and supplied as an intermediate column feed.

Figure 6:
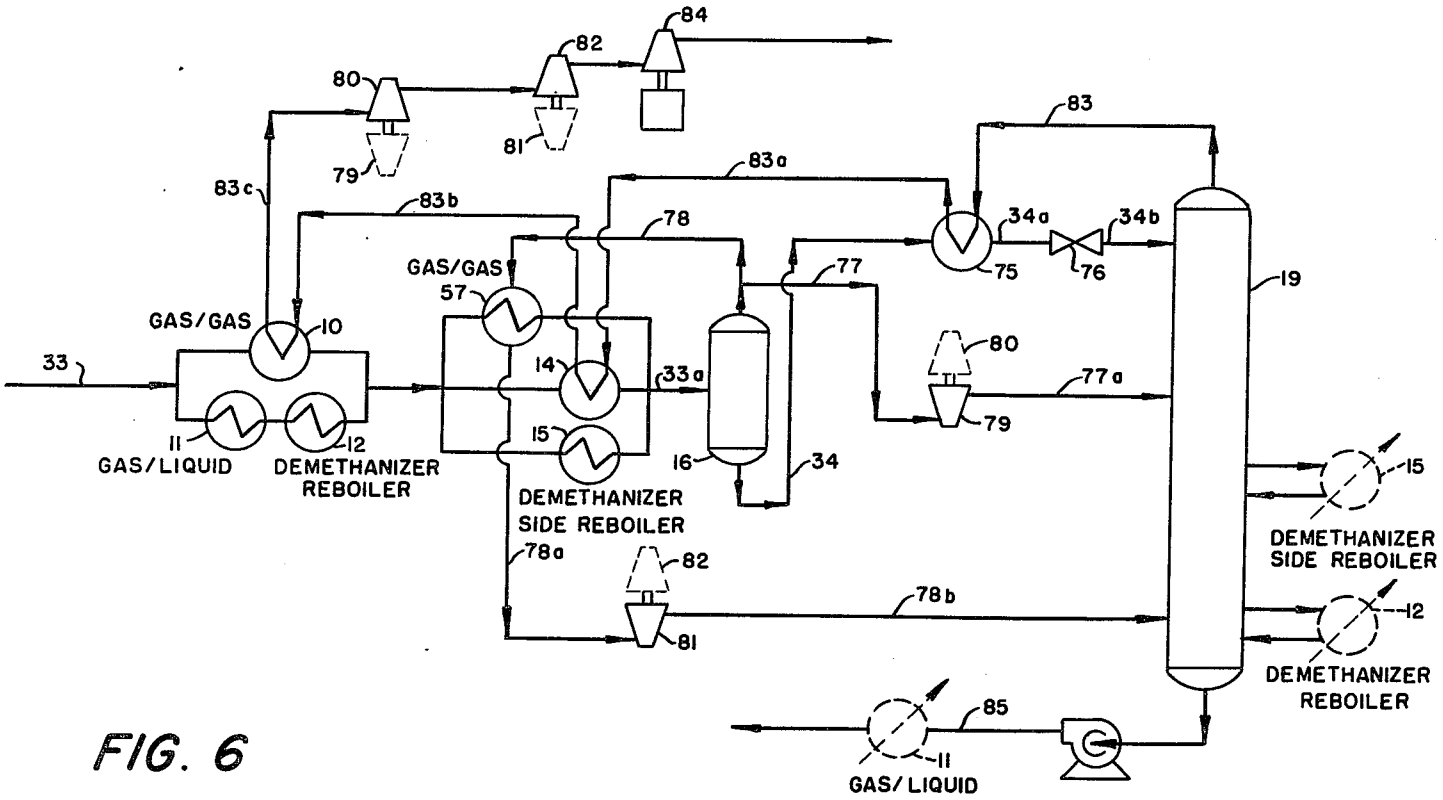

FIG. 6 is a variation of the present invention in which a portion of the high-pressure vapor is used as vapor turn-back and a portion is expanded directly to the demethanizer.

Figure 7A:
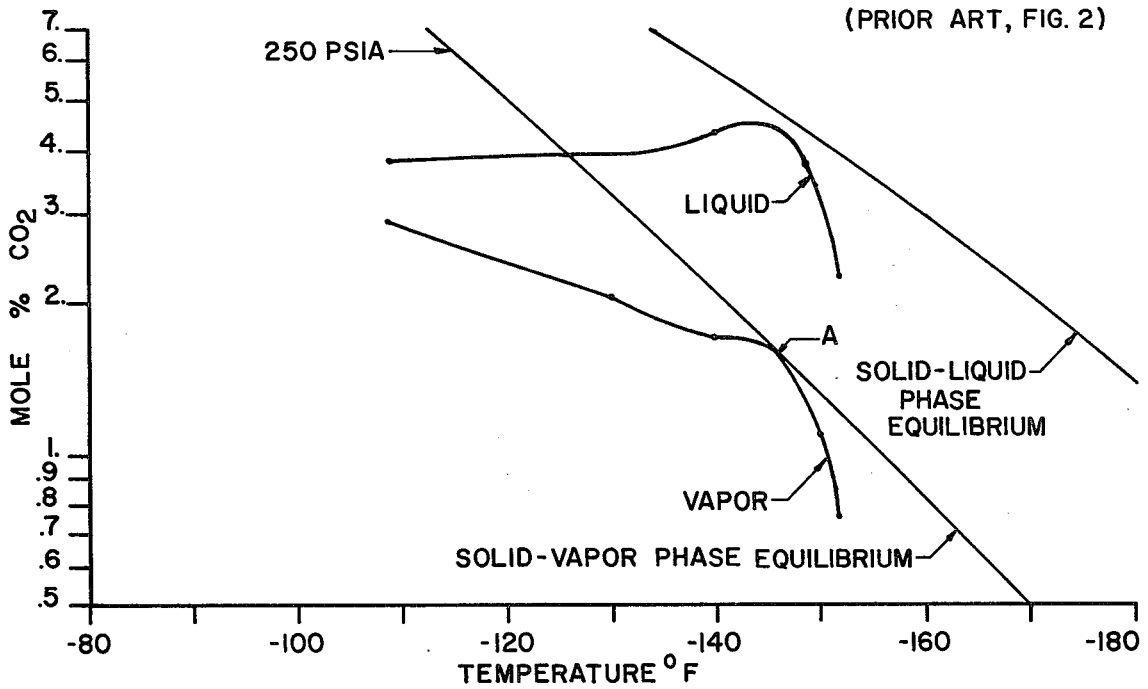
Figure 7B:
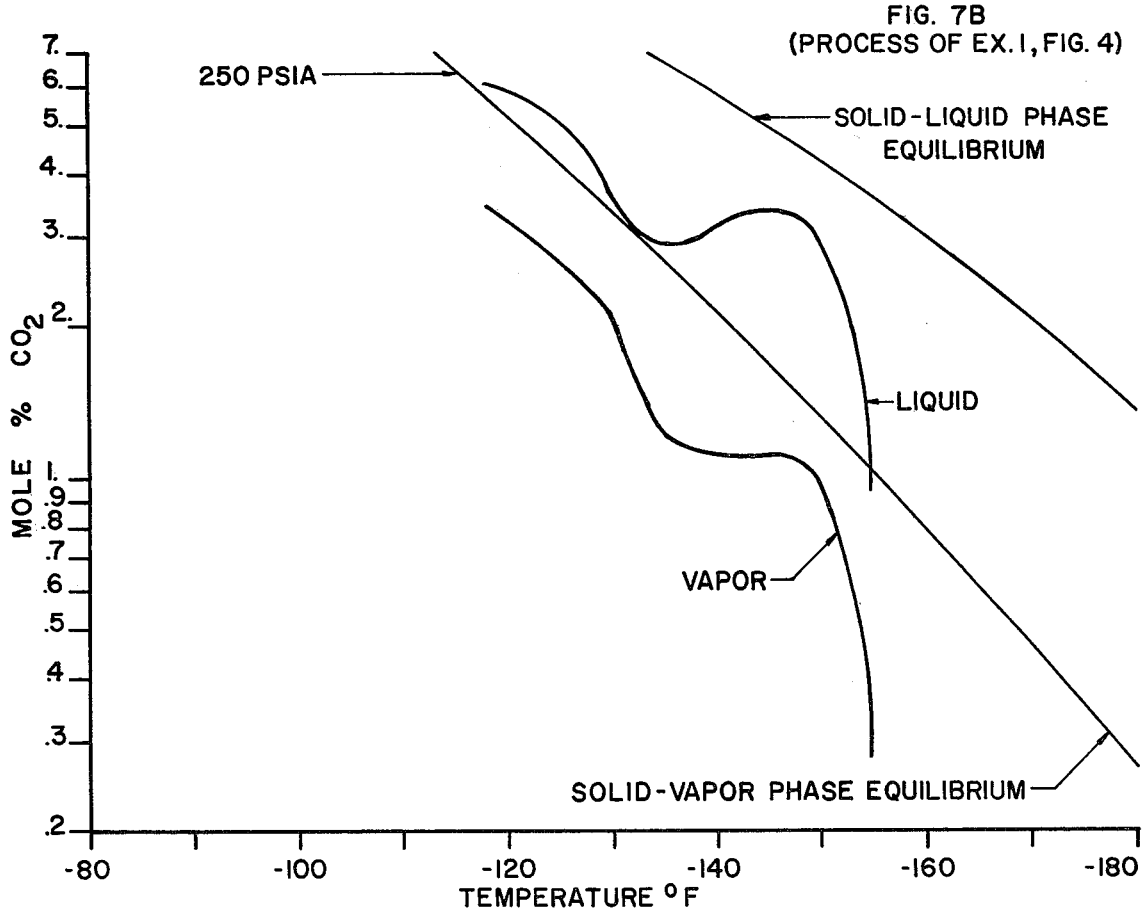

FIGS. 7A and 7B are graphs showing carbon dioxide as a function of temperature for one embodiment of this invention compared to the prior art.

In the following explanation of the above figures, tables are provided summarizing flow rates calculated for representative process conditions. In the tables appearing herein, the values for flow rates (in pound moles per hour) have been rounded to the nearest whole number, for convenience. The total stream flow rates shown in the tables include all non-hydrocarbon components and hence are generally larger than the sum of the stream flow rates for the hydrocarbon components. Temperatures indicated are approximate values, rounded to the nearest degree.

Figure 1:
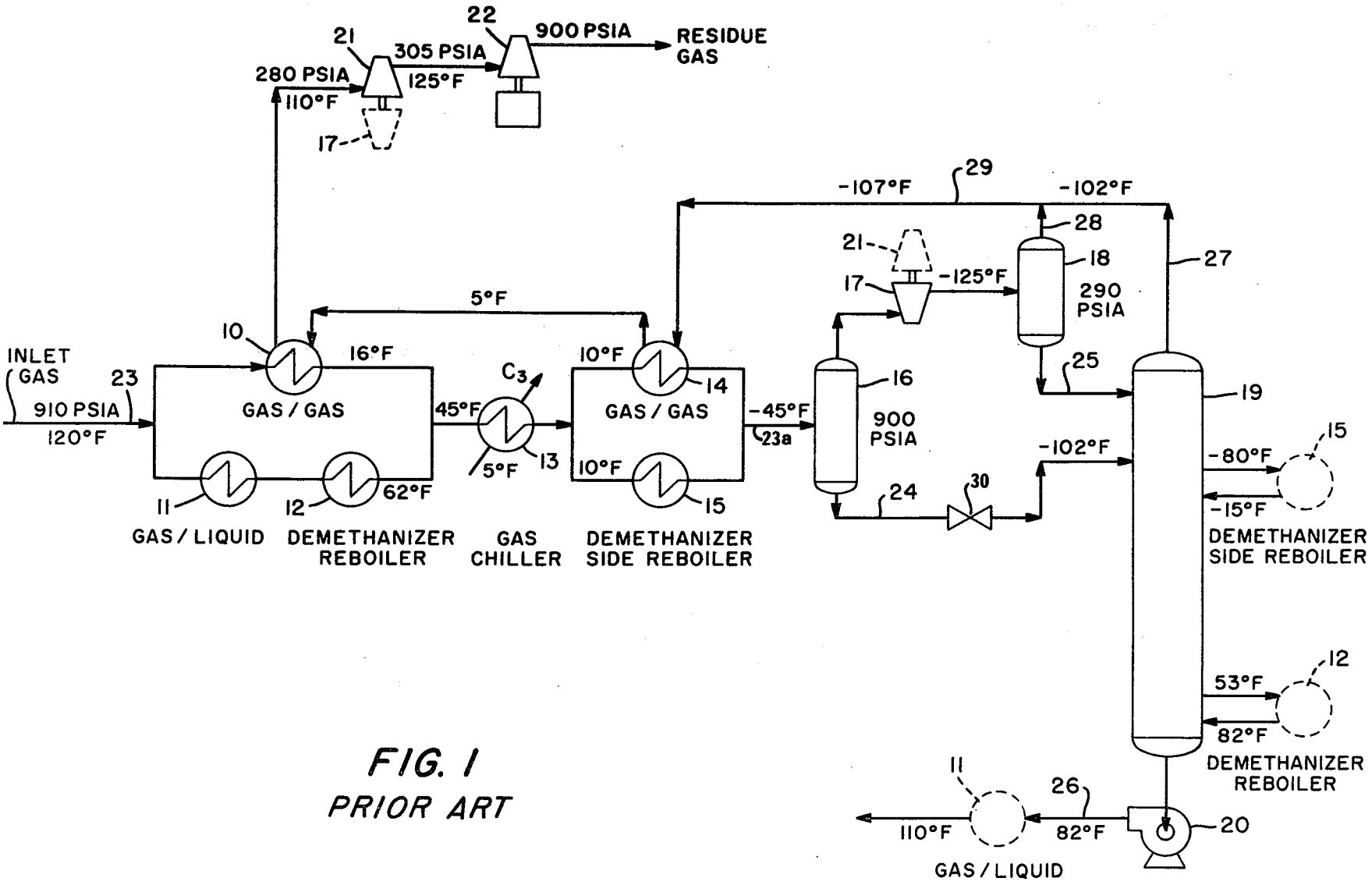
FIG. 1 PRIOR ART
FIG. 1 is a flow diagram of a single-stage cryogenic expander natural gas processing plant of the prior art incorporating a set of conditions for a typically rich natural gas stream.

Referring to FIG. 1, for a fuller description of a typical conventional ethane recovery process, plant inlet gas from which carbon dioxide and sulfur compounds have been removed (if the concentration of these compounds in the plant inlet gas would cause the product stream not to meet specifications, or cause icing in the equipment), and which has been dehydrated enters the process at 120° F. and 910 psia as stream 23. It is divided into two parallel streams and cooled to 45° F. by heat exchange with cool residue gas at 5° F. in exchanger 10; with product liquids (stream 26) at 82° F. in exchanger 11; and with demethanizer liquid at 53° F. in demethanizer reboiler 12. From these exchangers, the streams recombine and enter the gas chiller, exchanger 13, where the combined stream is cooled to 10° F. with propane refrigerant at 5° F. The cooled stream is again divided into two parallel streams and further chilled by heat exchange with cold residue gas (stream 29) at −107° F. in exchanger 14, and with demethanizer liquids at −80° F. in demethanizer side reboiler 15. The streams are recombined and enter a high-pressure separator 16 at −45° F. and 900 psia as stream 23*a*. The condensed liquid (stream 24) is separated and fed to the demethanizer 19 through expansion valve 30. An expansion engine may be used in place of the expansion valve 30 if desired.

The cooled gas from the high pressure separator 16 flows through expander 17 where it is work expanded from 900 psia to 290 psia. The work expansion chills the gas to −125° F. Expander 17 is preferably a turbo-expander, having a compressor 21 mounted on the expander shaft. For convenience, expander 17 is sometimes hereinafter referred to as the expansion means. In certain prior art embodiments, expander 17 is replaced by a conventional expansion valve.

Liquid condensed during expansion is separated in low pressure separator 18. The liquid is fed on level control through line 25 to the demethanizer column 19 at the top and flows from a chimney tray (not shown) as top feed to the column 19.

It should be noted that in certain embodiments low pressure separator 18 may be included as part of demethanizer 19, occupying the top section of the column. In this case, the expander outlet stream enters above a chimney tray at the bottom of the separator section, located at the top of the column. The liquid then flows from the chimney tray as top feed to the demethanizing section of the column.

As liquid fed to demethanizer 19 flows down the column, it is contacted by vapors which strip the methane from the liquid to produce a demethanized liquid product at the bottom. The heat required to generate stripping vapors is provided by heat exchangers 12 and 15.

The vapors stripped from the condensed liquid in demethanizer 19 exit through line 27 to join the cold outlet gas from separator 18 via line 28. The combined vapor stream then flows through line 29 back through heat exchangers 14 and 10. Following these exchangers, the gas flows through compressor 21 driven by expander 17 and directly coupled thereto. Compressor 21 compresses the gas to a discharge pressure of about 305 psia. The gas then enters a compressor 22 and is compressed to a final discharge pressure of 900 psia.

Inlet and liquid component flow rates, outlet liquid recoveries and compression requirements for this prior art process shown in FIG. 1 are given in the following table:

TABLE I (FIG. 1)
Stream Flow Rate Summary - Lb. Moles/Hr.

| Stream | Methane | Ethane | Propane | Butanes+ | Total |
|---|---|---|---|---|---|
| 23 | 1100 | 222 | 163 | 130 | 1647 |
| 24 | 795 | 202 | 157 | 129 | 1300 |
| 25 | 16 | 10 | 5 | 1 | 32 |
| 26 | 3 | 162 | 157 | 130 | 453 |

| RECOVERIES | | |
|---|---|---|
| Ethane | 72.9% | 29,296 GAL/DAY |
| Propane | 96.2% | 39,270 GAL/DAY |

| COMPRESSION HORSEPOWER | |
|---|---|
| Refrigeration | 256 BHP |
| Recompression | 892 BHP |
| Total | 1148 BHP |

Figure 2:
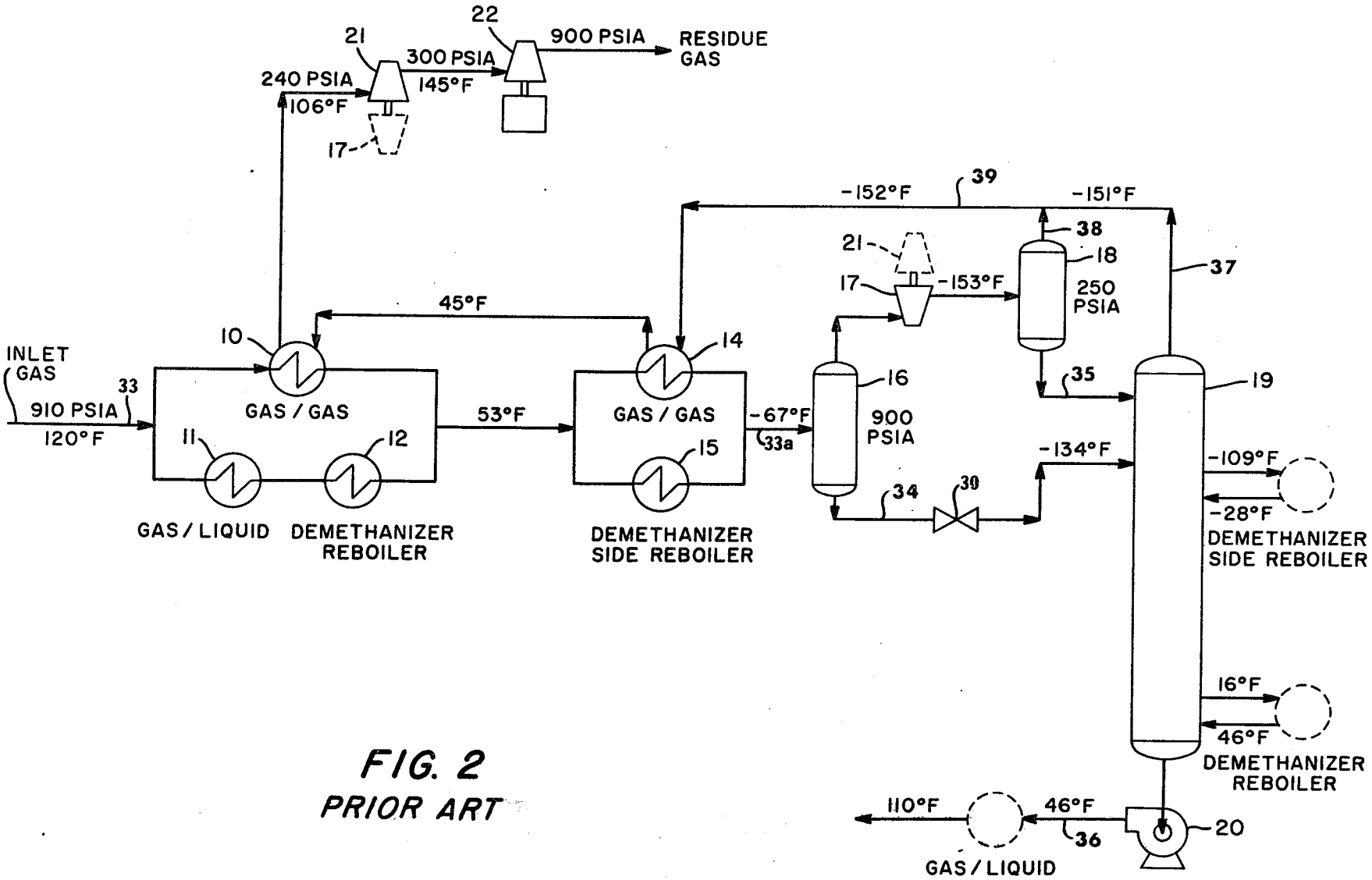
FIG. 2 PRIOR ART
FIG. 2 is a flow diagram of a single-stage cryogenic expander natural gas processing plant of the prior art incorporating a set of conditions for a typically lean natural gas stream.

In FIG. 2 a typical lean natural gas stream is processed and cooled using a prior art process similar to that shown in FIG. 1. The inlet gas stream 33 is cooled to −67° F. and flows to high pressure separator 16 as stream **33*a* where the liquid contained therein is separated and fed on level control through line 34 and expansion valve 30 to demethanizer 19** in the middle of the column.

Cold gas from separator 16 flows through expander 17 where because of work expansion from 900 psia to 250 psia, the gas is chilled to −153° F. The liquid condensed during expansion is separated in low pressure separator 18 and is fed on level control through line 35 to the demethanizer 19 as top feed to the column.

The data for this case are given in the following table:

TABLE II (FIG. 2)
Stream Flow Rate Summary - Lb. Moles/Hr.

| Stream | Methane | Ethane | Propane | Butanes+ | Total |
|---|---|---|---|---|---|
| 33 | 1447 | 90 | 36 | 43 | 1647 |
| 34 | 280 | 42 | 25 | 39 | 391 |
| 35 | 133 | 35 | 11 | 4 | 186 |
| 36 | 2 | 71 | 36 | 43 | 155 |

| RECOVERIES | | |
|---|---|---|
| Ethane | 79.0% | 17,355 GAL/DAY |
| Propane | 98.2% | 8,935 GAL/DAY |

| COMPRESSION HORSEPOWER | |
|---|---|
| Refrigeration | 0 BHP |
| Recompression | 1180 BHP |
| Total | 1180 BHP |

In the prior art cases discussed with respect to FIG. 1 and FIG. 2 above, recoveries of ethane are 73% for the case of the rich gas feed and 79% for the lean gas feed. It is recognized that some improvement in yield may result by adding one or more cooling steps followed by one or more separation steps, or by altering the temperature of separator 16 or the pressure in separator 18. Recoveries of ethane and propane obtained in this manner, while possibly improved over the cases illustrated by FIG. 1 and FIG. 2, are significantly less than yields which can be obtained in accordance with the process of the present invention.

For purposes of further comparison, a base case B has been calculated following the same flow diagram as in FIG. 3 but at a somewhat lower column pressure. Under the conditions of base case B, more refrigeration could be extracted from residue gas streams 43, **43*a* and 43*b*, and the demethanizer reboiler, making it possible to eliminate external refrigeration in heat exchanger 13**. This reduced the horsepower required by the process but also reduced the ethane and propane recoveries.

A summary of the process conditions of the principal streams for base case B is set forth below in Table III and a stream flow rate summary for base case B is set forth below in Table V.

TABLE III (FIG. 3)
STREAM CONDITIONS

| Stream | Base Case A | Base Case B |
|---|---|---|
| 33 | 120° F.; 910 psia | 120° F.; 910 psia |
| 33a, 34, 41, 42 | −67° F.; 900 psia | −67° F.; 900 psia |
| 41a | −145° F.; 290 psia | −148° F.; 275 psia |
| 43 | −154° F. | −154° F. |
| 43a | −75° F. | −112° F. |
| 43b | −27° F. | 25° F. |
| 43c | 98° F. | 115° F. |
| 44 | 46° F. | 44° F. |
| 47 | −146° F.; 900 psia | −145° F.; 900 psia |
| 47a | −155° F.; 290 psia | −155° F.; 275 psia |

As indicated above, the present invention may be used as an improvement in the gas recovery process as set forth in said co-pending application, Ser. No. 698,065 of June 21, 1976 and the continuation-in-part thereof, Ser. No. 712,825 filed concurrently herewith. FIG. 3 illustrates a gas recovery facility employing the invention described in these applications and will be employed as a base case for purposes of explaining the present invention. In addition, in the flow plan of FIG. 3, the subcooled liquid is combined with a portion of the vapors from partial condensation. Such a further step reduces the bubble point of the subcooled liquid as explained in our co-pending applications Ser. No. 712,771 filed Aug. 9, 1976, and Ser. No. 728,963 filed concurrently herewith. With respect to FIG. 3, the process flow conditions discussed below and flow rates set forth in Table III have been calculated on the basis of a lean feed gas composition as set forth in Table II as stream 33.

Referring to FIG. 3, plant inlet gas 33 from which carbon dioxide and sulfur compounds have been removed and which has been dehydrated enters the process at 120° F. and 910 psia. It is divided into two parallel streams and cooled to −3° F. by heat exchange with cool residue gas **43*b* at −27° F. in heat exchanger 10; with liquid product (stream 44) at 46° F. in heat exchanger 11; and with demethanizer liquid at 4° F. in demethanizer reboiler 12. After recombining the combined stream at −3° F. is further cooled to −21° F. by external refrigeration such as a propane refrigerant at −27° F. The stream is again divided into two parallel streams and is further cooled by heat exchange with cold residue gas stream 43*a* at −75° F. in heat exchanger 14 and with demethanizer liquids at −139° F. in demethanizer side reboiler 15. The streams are combined and supplied as stream 33*a* to high pressure separator 16 at −67° F. and 900 psia where the condensed liquid is separated. The liquid from separator 16 (stream 34) is combined with a portion of the vapor from separator 16 (stream 42). The combined stream then passes through heat exchanger 45 in heat exchange relation with overhead vapor stream 43 from the demethanizer. This cools and condenses the combined stream. The cooled and condensed stream at −146° F. is then expanded through an appropriate expansion device such as expansion valve 46 to a pressure of about 290 psia. During expansion, a portion of the feed will vaporize, resulting in cooling of the remaining portion. In the process illustrated in this case, expanded stream 47*a* leaving expansion valve 46 reaches a temperature of −155° F. and is supplied to the demethanizer 19** as the top feed.

The remaining vapor from separator 16 (stream 41) enters a work expansion engine in which mechanical energy is extracted from this portion of the high pressure vapor. As the vapor is expanded from a pressure of about 900 psia to about 290 psia, work expansion cools the expanded vapor **41*a* to a temperature of approximately −145° F. The expanded and partially condensed vapor 41*a* is supplied to the demethanizer 19** at an intermediate point.

The temperature and pressure conditions of some of the principal streams are summarized in Table III below as base case A, and a stream flow summary for base case A is set forth in Table IV below.

| RECOVERIES | Base Case A | Base Case B |
|---|---|---|
| Ethane | 92.56%; 20,323 Gal/Day | 90.52%; 19,876 Gal/Day |
| Propane | 97.89%; 8,910 Gal/Day | 97.56%; 8,881 Gal/Day |

| HORSEPOWER REQUIREMENTS | Base Case A | Base Case B |
|---|---|---|
| Refrigeration | 118 BHP | 0 BHP |
| Recompression | 1045 BHP | 1116 BHP |
| Total | 1163 BHP | 1116 BHP |

TABLE IV

-continued (FIG. 3)
Stream Flow Rate Summary, Base Case A - Lb. Moles/Hr.

| Stream | Methane | Ethane | Propane | Butanes+ | Total |
|---|---|---|---|---|---|
| 33 | 1447 | 90 | 36 | 43 | 1647 |
| 34 | 280 | 42 | 25 | 39 | 391 |
| 41 | 856 | 36 | 8 | 3 | 921 |
| 42 | 311 | 12 | 3 | 1 | 335 |
| 43 | 1446 | 6 | 0 | 0 | 1475 |
| 44 | 1 | 84 | 36 | 43 | 172 |

TABLE V (FIG. 3)
Stream Flow Rate Summary, Base Case B - Lb. Moles/Hr.

| Stream | Methane | Ethane | Propane | Butanes+ | Total |
|---|---|---|---|---|---|
| 33 | 1447 | 90 | 36 | 43 | 1647 |
| 34 | 280 | 42 | 25 | 49 | 391 |
| 41 | 1078 | 45 | 10 | 4 | 1160 |
| 42 | 89 | 3 | 1 | 0 | 96 |
| 43 | 1445 | 8 | 0 | 0 | 1479 |
| 44 | 2 | 82 | 36 | 43 | 168 |

The present invention is illustrated by the following examples:

EXAMPLE 1

FIG. 4 sets forth a process diagram for a typical natural gas plant in accordance with the present invention.

The flow plan is similar to the flow plan of FIG. 3 except for the provision for vapor turnback. In FIG. 4, inlet gas is cooled and partially condensed through heat exchangers 10, 11, 12, 14 and 15 generally as described in connection with FIG. 3. It will be noted, however, that it was not found necessary in FIG. 4 to make provision for external refrigeration (e.g., heat exchanger 13 of FIG. 3). Moreover, in FIG. 4, it will also be noted that in the second set of feed gas coolers, the feed is divided into three portions rather than two. A portion of the feed is cooled in heat exchanger 57, as will be further explained below; another portion is cooled in heat exchanger 14 by heat exchange with cool residue gas stream **52*a*; and the third portion is cooled in heat exchanger 15 by heat exchange with demethanizer liquid in demethanizer side reboiler 15. The cooled and partially condensed feed gas 33*a* is supplied to separator 16** at −67° F. and 900 psia.

Following first the liquid from separator 16, stream 34 is combined with a portion 50 of the vapor from separator 16. The combined stream then passes through heat exchanger 54 in heat exchange relation with the overhead vapor product (stream 52) from demethanizer 19, resulting in cooling and condensation of the combined stream. The cooled stream 55 is then expanded through an appropriate expansion device, such as expansion valve 56, to a pressure of about 290 psia. During expansion, a portion of the feed will vaporize, resulting in cooling of the remaining part. In the process of FIG. 4, the expanded stream **55*a* leaving expansion valve 56 reaches a temperature of −155° F., and is supplied to demethanizer 19** as top feed.

The remaining vapor from separator 16 (stream 51) becomes the turn-back stream. The vapor turn-back 51 flows through heat exchanger 57 in heat exchange relation with part of the plant inlet feed. In the process of FIG. 4, the turn-back vapor **51*a* from exchanger 57 is at about 5° F. and flows through expander 17 where because of work expansion from about 895 psia to 290 psia, the gas 51*b*** is chilled to −99° F. The chilled stream 51*b* from expander 17 flows to demethanizer 19 at an intermediate point.

A summary of the principal streams in this example of the present case is set forth below in Table VI.

As will be seen from Table VI below, in this example of the present invention 92.53% of the ethane and 97.88% of the propane were recovered, 1005 brake horsepower of recompression were required to operate the process. By comparison with base case A above, it will be seen that for substantially the same recovery, the present invention reduces the horsepower requirements for process operation and in the case of this example eliminated the need for external refrigeration.

TABLE VI (FIG. 4)
Stream summary, Example 1.

| Stream | Methane | Ethane | Propane | Butanes+ | Total | Conditions |
|---|---|---|---|---|---|---|
| 33 | 1447 | 90 | 36 | 43 | 1647 | 120° F, 910 psia |
| 33a | 1447 | 90 | 36 | 43 | 1647 | −67° F, 900 psia |
| 34 | 280 | 42 | 25 | 39 | 391 | −67° F |
| 50 | 311 | 12 | 3 | 1 | 335 | −67° F |
| 51 | 856 | 36 | 8 | 3 | 921 | −67° F |
| 51a | 856 | 36 | 8 | 3 | 921 | 5° F., 895 psia |
| 51b | 856 | 36 | 8 | 3 | 921 | −99° F., 290 psia |
| 52 | 1445 | 6 | 0 | 0 | 1475 | −154° F., 290 psia |
| 52a | 1445 | 6 | 0 | 0 | 1475 | −75° F |
| 52b | 1445 | 6 | 0 | 0 | 1475 | 8° F |
| 52c | 1445 | 6 | 0 | 0 | 1475 | 110° F |
| 53 | 2 | 84 | 36 | 43 | 172 | 45° F |
| 55 | 591 | 54 | 28 | 40 | 726 | −146° F, 900 psia |
| 55a | 591 | 54 | 28 | 40 | 726 | −155° F, 290 psia |

RECOVERIES

| | | |
|---|---|---|
| Ethane | 92.53% | 20,318 GAL/DAY |
| Propane | 97.88% | 8,910 GAL/DAY |

HORSEPOWER REQUIREMENTS

| | | |
|---|---|---|
| Refrigeration | | 0 BHP |
| Recompression | | 1005 BHP |
| | Total | 1005 BHP |

EXAMPLE 2

Example 2 (FIG. 5) is another illustration of the present invention. In Example 2, a portion of the high-pressure liquid condensate was sub-cooled by residue gas from the demethanizer and flashed directly into the demethanizer at an intermediate feed position in the column.

Referring to FIG. 5, the inlet gas is processed and cooled in a manner similar to that of FIG. 4 in heat exchangers 10, 11, 12, 14, 15 and 57 to provide a partly condensed feed gas 33*a* at −67° F. at −900 psia. The cooled inlet stream 33*a* then enters high-pressure separator 16 where the condensed liquid is separated.

The vapor from high-pressure separator 16 is divided into two portions. The first portion 60 is combined with a portion 64 of the liquid 34 stream from exchanger 62 wherein liquid 31 from separator 16 is sub-cooled. The remaining portion of vapor from separator 16 enters heat exchanger 57 where it is used to cool a portion of plant inlet feed gas. From exchanger 57 the vapor stream 61*a* enters expander 17 where, because of work expansion from 895 psia to 250 psia, the gas is chilled to −108° F. From expander 17 the stream 61*b* flows to demethanizer 19 at its lowerst point.

The cooled liquid 34 from high pressure separator 16 enters heat exchanger 62 where it is sub-cooled to about −150° F. by heat exchange with a portion of cold residue gas 70. Following exchanger 62 the sub-cooled liquid is divided into two portions. The first portion 63 flows through expansion valve 65 where it undergoes expansion and flash vaporization and is cooled to −158° F. From expansion valve 65 the stream 63*a* enters demethanizer 19 at its middle feed point. The remaining liquid portion 64 is combined with a portion 60 of the high pressure separator vapor. The combined stream then flows through heat exchanger 66 where it is cooled to −153° F. by heat exchange with a portion of the cold residue gas stream 70. From exchanger 66 the sub-cooled stream 67 enters expansion valve 68 and undergoes flash vaporization as the pressure is reduced to about 250 psia. From valve 68, the stream 67*a* now at −163° F. flows to demethanizer 19 at its top feed point.

The vapors stripped from the condensed liquid in demethanizer 19 exit as residue gas 70. As already indicated, the residue gas 70 is divided and used as the refrigerant in exchangers 62 and 66. The residue gas from these exchangers is recombined and flows through the balance of the system to exchangers 14 and 10 where it is used to cool and partially condense the feed gas 33.

A summary of the condition of some of the principal streams is set forth in Table VII.

TABLE VII (FIG. 5)
Stream Conditions and Flow Rates

| Stream | Methane | Ethane | Propane | Butanes+ | Total | Condition |
|---|---|---|---|---|---|---|
| 33 | 1447 | 90 | 36 | 43 | 1647 | 120° F., 910 psia |
| 33a | 1447 | 90 | 36 | 43 | 1647 | −67° F., 900 psia |
| 34 | 280 | 42 | 25 | 39 | 391 | −67° F. |
| 60 | 164 | 6 | 2 | 1 | 176 | −67° F. |
| 61 | 1003 | 42 | 9 | 3 | 1080 | −67° F |
| 61a | 1003 | 42 | 9 | 3 | 1080 | 5° F., 900 psia |
| 61b | 1003 | 42 | 9 | 3 | 1080 | −108° F., 250 psia |
| 63 | 140 | 21 | 12 | 19 | 195 | −150° F., 900 psia |
| 63a | 140 | 21 | 12 | 19 | 195 | −158° F., 250 psia |
| 64 | 140 | 21 | 12 | 19 | 195 | −150° F., 900 psia |

TABLE VII-continued (FIG. 5)
Stream Conditions and Flow Rates

| | | | | | | |
|---|---|---|---|---|---|---|
| 67 | 304 | 27 | 14 | 20 | 272 | −153° F., 900 psia |
| 67a | 304 | 27 | 14 | 20 | 272 | −163° F., 250 psia |
| 70 | 1444 | 6 | 0 | 0 | 1479 | −161° F., 250 psia |
| 71 | 3 | 84 | 36 | 43 | 168 | 39° F. |

RECOVERIES

| | | |
|---|---|---|
| Ethane | 93.02% | 20,426 GAL/DAY |
| Propane | 98.57% | 8,972 GAL/DAY |

COMPRESSION HORSEPOWER

| | |
|---|---|
| Refrigeration | 0 BHP |
| Recompression | 1111 BHP |
| Total | 1111 BHP |

The foregoing invention of turning back some (or all) of the high pressure feed gas vapors separated upon partial condensation is generally applicable in process flow plans where an alternate stream is available to maintain the demethanizer column at the desired overhead operating temperature. Cooling of high-pressure condensate prior to expansion, and supplying the cooled expanded condensate at at upper feed point in the column is a particularly preferred means of maintaining column overhead temperature. As indicated above, in co-pending application Ser. No. 698,065, Ser. No. 712,825, and Ser. No. 728,962 of Campbell, Wilkinson and Rambo, a variety of processes are disclosed for cooling of the high-pressure condensate recovered from the feed gas before expanding that condensate to the demethanizer operating pressure. The advantages of cooling the high pressure condensate before expansion can be enhanced in accordance with our co-pending application No. 712,771 by combining that condensate with a portion of the vapor from the high-pressure separator in order to lower the temperature which would be obtained upon expansion of the condensate.

Variations of the invention of this application include the following:

(1) Some or all of the high-pressure condensate may be cooled by auto-refrigeration. In such a procedure, a cooled portion of the high-pressure condensate is divided into two portions. One portion is expanded to the column operating pressure which causes a portion of it to vaporize and to cool the expanded stream. The expanded portion is then directed into heat exchange relation with the high-pressure condensate to obtain the cooled condensate prior to expansion. The second portion of the cooled stream is expanded to a low temperature and supplied to the demethanizer as the column top feed. In this embodiment the cooled high-pressure condensate may be divided into two portions and each portion separately expanded. If more convenient, the entire cooled condensate stream can be expanded to the demethanizer pressure, and the expanded stream resulting then divided into the two portions discussed above.

(2) In another variation, all or a portion of the high-pressure condensate supplied as the top column feed may be heat exchanged prior to expansion with liquid in the demethanizer column in one or more side stream reboilers.

(3) In either variation (1) or (2), the amount of cooling obtained by expansion of the cooled high-pressure liquid can be enhanced by combining the high-pressure condensate with a portion of the high-pressure vapor as explained in our co-pending application, Ser. No. 712,771 and Ser. No. 728,962. This variation is also applicable, as shown in FIGS. 4 and 5, to cases where the high-pressure condensate is cooled by residue gas. This variation is particularly valuable in the treatment of lean feed gases, where there is sometimes a limited amount of high-pressure condensate available.

(4) When employing turn-back of the high-pressure vapors, particularly in lean gas cases, very substantial amounts of high-pressure vapor are available and, if heated to too great an extent in the turn-back heat exchanger (e.g., exchanger 57 of FIGS. 4 and 5), the temperature reached by the turn-back gases after expansion will tend to overheat the demethanizer column and thus raise the column overhead temperature.

A number of expedients are available in such a situation: Only a portion of the high pressure vapors may be turned back through exchanger 57, and the balance of the high-pressure vapors supplied directly to the demethanizer to maintain column overhead temperature. The balance thus supplied directly to the demethanizer may be expanded in a turbo-expander, may be cooled (or partially condensed) by heat exchange against column overhead vapors and expanded into the demethanizer column or it may be used to enrich all or a portion of the high-pressure liquid condensate as explained above. Still another alternate would be to cool the expanded turn-back vapors if a cooling stream is available at an appropriate temperature within the process. In cases where large amounts of vapors are available for use as a turn-back stream, it may be necessary, to avoid overheating the demethanizer, to limit the temperature to which the turned-back vapors are warmed in exchanger 57.

(5) In the illustrations of the present invention set forth in the above examples, the turn-back vapors have been used to cool a portion of the incoming feed gas in the second set of heat exchangers (i.e., in parallel with exchangers 14 and 15 of FIGS. 4 and 5). It will be appreciated, however, that in a gas treatment process as generally illustrated in FIGS. 1 through 5 there may be a variety of alternate needs for a cold gas stream, such as is available from the high-pressure separator, where the refrigeration therein may be used even more effectively than indicated in examples 1 and 2. By way of illustration, the turned-back vapors may be used in lieu of propane refrigeration in a heat exchanger located intermediate between the two sets of feed gas precoolers such as heat exchanger 13 of FIG. 1. Still another variant, the turned-back vapors may be used to cool all or a portion of the incoming feed gas at the initial condition of 120° F. such as through exchangers 10, 11, or 12 of FIGS. 1 and 2. Still another variation, where propane refrigeration is employed, is to use the turned-back vapors to subcool the condensed propane refrigerant prior to employing the refrigerant in the process operation.

(6) In still another variation of the present invention, the feed gas vapor from separator 16 may be divided into two portions, the first of which is used as the vapor turn-back and the second of which is used to control the column overhead. In this embodiment, the second stream would be heat exchanged against cold residue gas from the demethanizer overhead. This may result in substantial condensation of the cooled feed gas vapor if the vapor is below its critical pressure. If the stream is above the critical pressure, it will remain single phase through the cooling. The second portion would then be expanded and supplied as the top column feed. The vapor turn-back portion would be reheated as previously described, work expanded, and supplied as a lower column feed. In these variations the expanded turn-back vapors may also be heat exchanged with residue gas.

(7) The process flow plans and examples of the present invention have been described for convenience using shell and tube heat exchangers. In cryogenic operations, it is usually preferred to use specially designed heat exchangers such as plate-fin heat exchangers. Such special heat exchangers have improved heat transfer characteristics which may permit closer temperature approaches in the heat exchangers, lower cost, and also permit flow arrangements to accommodate heat exchange of several streams concurrently.

EXAMPLE 3

Example 3, as illustrated in FIG. 6, is an example of the present invention in which a portion of the high-pressure feed gas obtained from partial condensation is employed as turn-back vapor and another portion is expanded directly to column pressure through a work expansion engine.

Referring to FIG. 6, a lean feed gas is supplied to the process at a temperature of 120° F. and a pressure of 910 psia at stream 33. Lean feed gas 33 is of the same composition referred to above in connection with FIG. 2. The feed gas is cooled to a temperature of −67° F. and a pressure of 900 psia through heat exchanges 10, 11, 12, 14, 15, and 57, generally as described above in connection with FIGS. 4 and 5. The partially condensed feed **33*a* is supplied to separator 16 wherein the liquid and vapor is separated. Liquid portion 34 is drawn off from separator 16, cooled in heat exchanger 75 to a temperature of −150° F. (stream 34*a*), and then passed through expansion valve 76. The expanded stream 34*b* at −158° F. is supplied to demethanizer 19** as a top column feed.

The vapors drawn off from separator 16 are separated into two portions, 77 and 78. Portions 77 is expanded in work expansion engine 79. The expanded stream **77*a* achieves a temperature of −153° F. and is supplied to the demethanizer as an intermediate column feed. Work extracted from stream 77 in expander 79 is in part employed to recompress residue gas by means of associated compressor 80**.

Turn-back vapors 78 from separator 16 are directed through heat exchanger 57 to precool a portion of liquid feed 33. The warmed turn-back vapors **78*a* leave exchanger 57 at a temperature of 50° F. The warmed vapors are then expanded in expansion engine 81 and supplied to the demethanizer column as a second intermediate feed at a feed point below feed 77*a* at −77° F. Expander 81 is connected to an associated compressor 82**.

Residue gas in the process illustrated in FIG. 6 is obtained as a demethanizer overhead 83. Demethanizer overhead is employed to provide a part of the refrigeration required in the process by cooling (i) liquid 34 in exchanger 75, (ii) partly cooled feed gas in exchanger 14, and (iii) hot feed gas in exchanger 10. Thereafter, the residue gas is recompressed to line pressure first in compressor 80 driven by work engine 79; second, in compressor 82 driven by work engine 81; and finally, in supplementary compressor 84.

A summary of the principal stream flow rates and conditions is set forth below in Table VIII. As can be seen, in the process illustrated in FIG. 6, an ethane recovery of 89.16% and propane recovery of 97.73% at a total horsepower requirement of 1057 BHP.

TABLE IX (FIG. 6)
Process Stream Summary

| Stream | Methane | Ethane | Propane | Butanes+ | Total | Conditions |
|---|---|---|---|---|---|---|
| 33 | 1447 | 90 | 36 | 43 | 1647 | 120° F., 910 psia |
| 33a | 1447 | 90 | 36 | 43 | 1647 | −67° F., 900 psia |
| 34 | 280 | 42 | 25 | 39 | 391 | −67° F. |
| 34a | 280 | 42 | 25 | 39 | 391 | −150° F., 900 psia |
| 34b | 280 | 42 | 25 | 39 | 391 | −158° F., 250 psia |
| 77 | 584 | 24 | 5 | 2 | 628 | −67° F., 900 psia |
| 77a | 584 | 24 | 5 | 2 | 628 | −153° F., 250 psia |
| 78 | 584 | 24 | 5 | 2 | 628 | −67° F., 900 psia |
| 78a | 584 | 24 | 5 | 2 | 628 | 50° F., 895 psia |
| 78b | 584 | 24 | 5 | 2 | 628 | −77° F., 250 psia |
| 83 | 1445 | 10 | 1 | 0 | 1483 | −156° F., 250 psia |
| 83a | 1445 | 10 | 1 | 0 | 1483 | −124° F. |
| 83b | 1445 | 10 | 1 | 0 | 1483 | 70° F. |
| 83c | 1445 | 10 | 1 | 0 | 1483 | 84° F. |
| 85 | 2 | 81 | 36 | 43 | 164 | 42° F. |

RECOVERIES

| | | |
|---|---|---|
| Ethane | 89.16% | 19,578 GAL/DAY |
| Propane | 97.73% | 8,896 GAL/DAY |

COMPRESSION HORSEPOWER

| | |
|---|---|
| Refrigeration | 0 BHP |
| Recompression | 1057 BHP |
| | 1057 BHP |

As is well known, natural gas streams usually contain carbon dioxide, sometimes in substantial amounts. The presence of carbon dioxide in the demethanizer can lead to icing of the column internals under cryogenic conditions. Even when feed gas contains less than 1% carbon dioxide it fractionates in the demethanizer, and can build up to concentrations of as much as 5% to 10% or greater. At such concentrations, carbon dioxide can freeze out depending on temperature, pressure, whether the carbon dioxide is in the liquid or vapor phase, and the solubility of carbon dioxide in the liquid phase.

In the present invention, it has been found that when the vapor from the high pressure separator is expanded and supplied to the demethanizer below the top column feed position, the problem of carbon dioxide icing can be substantially mitigated. The high-pressure separator gas typically contains a large amount of methane relative to the amount of ethane and carbon dioxide. When supplied as a mid-column feed, therefor, the high-pressure separator gas tends to dilute the carbon dioxide concentration and to prevent it from increasing to icing levels.

The advantage of the present invention can be readily seen by plotting carbon dioxide concentration and temperature for various trays of the demethanizer when practicing the present invention and when following the prior art. A chart thus constructed for processing the gas as described above in Example 1 (see FIG. 4 and Table IV) and containing 0.72% carbon dioxide, can be compared with a similar chart constructed for the process of FIG. 2 (prior art) applied to the same gas (see FIGS. 7-A and 7-B). These charts also include equilibria for vapor-solid and liquid-solid conditions. The equilibrium data given in FIGS. 7A and 7B are for the methane-carbon dioxide system. These data are generally considered representative for the methane and ethane systems. If the $CO_2$ concentration at a particular point in the column is at or above the equilibrium level for that temperature, icing can be expected. For practical design purposes, the engineer usually requires a margin of safety, i.e., the actual concentration be less than the "icing" concentration by a suitable safety factor.

As is evident, when following the prior art process of FIG. 2 (per FIG. 7-A), the vapor conditions at point A touches the line representing solid vapor phase equilibria. By contrast, in FIG. 7-B, neither the liquid nor vapor conditions reach or exceed their related equilibria condition. Hence, icing risks are materially reduced.

It should be noted in connection with the foregoing that when designing demethanizer columns for use in the present invention the designer will routinely verify that icing in the column will not occur. Even when vapor is fed at a mid column position it is possible that icing may occur if the process is designed for the highest possible ethane recovery. Such designs normally call for the coldest practical temperature at the top of the column. This will result in the carbon dioxide concentrations shifting to the right on the plots of FIGS. 7-A and 7-B. Depending on the particular application, the result can be an objectionably high concentration of carbon dioxide near the top of the column. For such a circumstance, it may be necessary to accept a somewhat lower ethane recovery to avoid column icing or to pretreat the feed gas to reduce carbon dioxide levels to the point where they can be tolerated in the demethanizer. In the alternative, it may be possible to avoid icing in such a circumstance by other alterations in the process conditions. For instance, it may be possible to operate the high pressure separator at a different temperature, to change the amount of re-heat, or to increase the quantity of vapor directed through the re-heater. If such alterations can be made within the limitations of the process heat balance, icing may be avoided without significant loss of ethane recovery.

In connection with the foregoing description of our invention, it should be noted that where the feed to the top of the demethanizer is a liquid which is expanded from a high pressure to a lower column operating pressure (as in FIGS. 4, 5, and 6), liquid may be auto cooled before expansion. Such auto cooling will involve splitting the top liquid feed into two streams either before or after expansion, and directing one of the two streams thus obtained after expansion into heat exchange relation with the top column liquid feed before expansion.

We claim:

1. In an apparatus for the separation of a feed gas into a volatile residue gas and a relatively less volatile fraction, said feed gas containing hydrocarbons, methane and ethane together comprising a major portion of the feed gas, said apparatus having (a) cooling means for cooling said feed gas under pressure to partially condense it and to form thereby a liquid portion and a feed gas vapor;

(b) sub-cooling means connected to said cooling means to receive at least some of said liquid portion, and to sub-cool it to a temperature below its bubble point;

(c) expansion means connected to said sub-cooling means (a) to receive the sub-cooled liquid portion and to expand it to a lower pressure;

(d) a fractionation column connected to receive at least a portion of the expanded sub-cooled liquid portion at a first feed point and to separate said relatively less volatile fraction;

(e) a second expansion means connected to said cooling means (a) to receive said feed gas vapor and to expand it to said lower pressure, said second expansion means being further connected to said fractionation column to supply at least a portion of the expanded feed gas vapor thereto as a feed, the improvement comprising (i) dividing means connected to said cooling means (a) to receive said feed gas vapor and to divide it into a first part and a second part;

(ii) means connecting said dividing means (i) to receive said first part of said feed gas vapor and supply it to said second expansion means (4) wherein said first part is expanded and supplied to said fractionation column;

(iii) heat exchange means connected to said dividing meas (i) to receive said second part of said feed gas vapor, said heat exchange means being further connected to receive a portion of said feed gas under pressure, thereby to direct said second part of said feed gas vapor into heat exchange relation with said feed gas under pressure to reheat said feed gas vapor;

(iv) expansion means connected to said heat exchange means (iii) to receive said reheated second part of said feed gas vapor and to expand it to said lower pressure while extracting work therefrom; and (v) means connecting said expansion means (iv) to said fractionation column at a second feed point to supply said expanded second part to said fractionation column at said second feed point, said second feed point being at a lower column position than said first feed point.

2. The improvement according to claim 1 wherein said sub-cooling means (b) includes means to direct the liquid portion to be sub-cooled into heat exchange relation with at least a portion of said residue gas, thereby to cool said first part prior to expansion thereof.

3. The improvement according to claim 1 including a further heat exchange means connected between said expansion means (iv) and said fractionation column to receive expanded second part, said further heat exchange means being further connected to direct said expanded second part into heat exchange relation with at least a portion of said residue gas, thereby no further cool said expanded second part prior to supplying it to the fractionation column at said second feed point.

4. In a process for separation of a feed gas into a volatile residue gas and a relatively less volatile fraction, said feed gas containing hydrocarbons, methane and ethane together comprising a major portion of the feed gas, wherein (1) said feed gas under pressure is cooled to partially condense said gas and form thereby a liquid portion and a feed gas vapor;

(2) at least some of the liquid portion thereby obtained is cooled to a temperature below its bubble point;

(3) the cooled liquid portion is expanded in an expansion means to a lower pressure whereby a first part of said liquid portion vaporizes to cool the expanded liquid portion;

(4) at least part of said expanded liquid portion is thereafter supplied to a fractionation column at a first feed point wherein said relatively less volatile fraction is separated;

(5) said feed gas vapor is expanded to said lower pressure in a work-expansion machine, wherein work is extracted therefrom; and (6) at least part of the expanded feed gas vapor is supplied to said fractionation column, the improvement comprising means for turning back at least a portion of said feed gas vapor prior to expansion thereof, wherein (a) said cooled liquid from step (2) is divided into a first part and a remaining part;

(b) said first part is expanded to said lower pressure, whereby a portion thereof vaporizes to cool the expanded first part;

(c) said expanded first part is directed into heat exchange relation with at least some of the liquid portion obtained in step (1), whereby said cooled liquid in step (2) is obtained;

(d) said remaining part is expanded to said lower pressure and at least some of the expanded remaining part is supplied to said demethanizer at the first feed point;

(e) at least some of said gas vapor from step (1) is reheated;

(f) thereafter said reheated feed gas vapor is expanded in a work-expansion machine; and (g) the expanded, reheated portion from step (f) is supplied to said fractionation column at a second feed point, said second feed point being at a lower column position than said first feed point.

5. In an apparatus for the separation of a feed gas into a volatile residue gas and a relatively less volatile fraction, said feed gas containing hydrocarbons, methane and ethane together comprising a major portion of the feed gas, said apparatus having (a) cooling means for cooling said feed gas under pressure to partially condense said gas sufficiently to form a liquid portion and a feed gas vapor;

(b) sub-cooling means connected to said cooling means (a) to receive at least some of said liquid portion and to sub-cool it to a temperature below its bubble point;

(c) a first expansion means connected to said sub-cooling means to receive the sub-cooled liquid portion and to expand it to a lower pressure, whereby a part of said liquid portion vaporizes to cool the expanded sub-cooled liquid portion;

(d) a fractionation column connected to said first expansion means to receive at least part of the expanded sub-cooled liquid portion at a first feed point and to separate said relatively less volatile fraction; and (e) a second expansion means connected to said cooling means (a) to receive feed gas vapor therefrom and expand it to said lower pressure in a work-expansion engine, wherein work is extracted therefrom, said second expansion means being further connected to said fractionation column to supply at least part of the expanded feed gas vapor to said fractionation column, the improvement comprising means for turning back at least a portion of said feed gas vapor prior to expansion thereof, said turn-back means comprising (1) dividing means connected to receive at least part of sub-cooled liquid portion from said sub-cooling means (b) and to divide it into a first part and a remaining part;

(2) means connected to said dividing means (1) to receive said first part and to expand said first part to said lower pressure, whereby a portion thereof vaporizes to cool the expanded first part;

(3) means connected to said means (2) to receive expanded first part and to direct said first expanded part to said sub-cooling means (b), wherein it passes in heat exchange relation with the liquid portion to be sub-cooled;

(4) means connected to said dividing means (1) to receive said remaining part and to supply it to said first expansion means (c) wherein it is cooled, and from which at least a portion thereof is supplied to said fractionation column at said first feed point;

(5) heat exchange means connected to said cooling means (a) to receive at least a portion of said feed gas vapor, said heat exchange means being connected to reheat said portion of said feed gas vapor;

(6) a third expansion means connected to said heat exchange means (5) to receive said reheated portion of said feed gas vapor and to expand said reheated portion to said lower pressure while extracting work therefrom; and (7) means connecting said third expansion means (6) to said fractionation column (d) to supply the expanded reheated feed gas thereto at a second feed point, said second feed point being at a lower position on said fractionation column than said first feed point.

6. In an apparatus for the separation of a feed gas into a volatile residue gas and a relatively less volatile fraction, said feed gas containing hydrocarbons, methane and ethane together comprising a major portion of the feed gas, said apparatus having (a) cooling means for cooling said feed gas under pressure to partially condense said gas sufficiently to form a liquid portion and a feed gas vapor;

(b) sub-cooling means connected to said cooling means (a) to receive at least some of said liquid portion and to sub-cool it to a temperature below its bubble point;

(c) a first expansion means connected to said sub-cooling means to receive the sub-cooled liquid portion and to expand it to a lower pressure, whereby a part of said liquid portion vaporizes to cool the expanded sub-cooled liquid portion;

(d) a fractionation column connected to said first expansion means to receive at least part of the expanded sub-cooled liquid portion at a first feed point and to separate said relatively less volatile fraction;

(e) a second expansion means connected to said cooling means (a) to receive feed gas vapor therefrom and expand it to said lower pressure in a work-expansion engine, wherein work is extracted therefrom, said second expansion means being further connected to said fractionation column to supply at least part of the expanded feed gas vapor to said fractionation column, the improvement comprising means for turning back at least a portion of said feed gas vapor prior to expansion thereof, said turn-back means comprising (1) combining means connected to said cooling means (a) to combine a first portion of the feed gas vapor with said liquid portion to be sub-cooled prior to expansion thereof, to form thereby a combined stream;

(2) said sub-cooling means connected to cool at least one of the first portion of the feed gas vapor, the liquid portion to be sub-cooled and said combined stream, whereby said combined stream is cooled to a temperature below the bubble point of said liquid portion;

(3) means connected to supply the expanded combined stream at a temperature below the bubble point of said liquid portion to said first expansion means (c);

(4) heat exchange means connected to said cooling means (a) to receive a second portion of said feed gas vapor, said heat exchange means being connected to reheat said portion of said feed gas vapor;

(5) a third expansion means connected to said heat exchange means (4) to receive said reheated portion of said feed gas vapor and to expand said reheated portion to said lower pressure while extracting work therefrom; and (6) means connecting said third expansion means (5) to said fractionation column (d) to supply the expanded reheated feed gas thereto at a second feed point, said second feed point being at a lower position on said fractionation column than said first feed point.

7. In an apparatus for the separation of a feed gas into a volatile residue gas and a relatively less volatile fraction, said feed gas containing hydrocarbons, methane and ethane together comprising a major portion of the feed gas, said apparatus having (a) cooling means for cooling said feed gas under pressure to partially condense said gas sufficiently to form a liquid portion and a feed gas vapor;

(b) sub-cooling means connected to said cooling means (a) to receive at least some of said liquid portion and to sub-cool it to a temperature below its bubble point;

(c) a first expansion means connected to said sub-cooling means to receive the sub-cooled liquid portion and to expand it to a lower pressure, whereby a part of said liquid portion vaporizes to cool the expanded sub-cooled liquid portion;

(d) a fractionation column connected to said first expansion means to receive at least part of the expanded sub-cooled liquid portion at a first feed point and to separate said relatively less volatile fraction; and (e) a second expansion means connected to said cooling means (a) to receive feed gas vapor therefrom and expand it to said lower pressure in a work-expansion engine, wherein work is extracted therefrom, said second expansion means being further connected to said fractionation column to supply at least part of the expanded feed gas vapor to said fractionation column, the improvement comprising means for turning back at least a portion of said feed gas vapor prior to expansion thereof, said turn-back means comprising (i) means connected to said cooling means (a) to receive said feed gas vapor and to divide said feed gas vapor into at least a first part and a second part;

(ii) heat exchange means connected to said dividing means (i) to receive the first part of said feed gas vapor, said heat exchange means being connected to reheat said portion of said feed gas vapor;

(iii) a third expansion means connected to said heat exchange means (ii) to receive said reheated part of said feed gas vapor and to expand said reheated portion to said lower pressure while extracting work therefrom;

(iv) means connecting said third expansion means (iii) to said fractionation column (d) to supply the expanded reheated feed gas thereto at a second feed point, said second feed point being at a lower position on said fractionation column than said first feed point;

(v) expansion means connected to said dividing means (i) to receive said second part of said feed gas vapor and to expand said second part to said lower pressure; and (vi) means connecting said expansion means (v) to said fractionation column to supply the expanded second part of said feed gas vapor to said fractionation column at a feed point above said second feed point.

8. In an apparatus for the separation of a feed gas into a volatile residue gas and a relatively less volatile fraction, said feed gas containing hydrocarbons, methane and ethane together comprising a major portion of the feed gas, said apparatus having (a) cooling means for cooling said feed gas under pressure to partially condense said gas sufficiently to form a liquid portion and a feed gas vapor;

(b) sub-cooling means connected to said cooling means (a) to receive at least some of said liquid portion and to sub-cool it to a temperature below its bubble point;

(c) a first expansion means connected to said sub-cooling means to receive the sub-cooled liquid portion and to expand it to a lower pressure, whereby a part of said liquid portion vaporizes to cool the expanded sub-cooled liquid portion;

(d) a fractionation column connected to said first expansion means to receive at least part of the expanded sub-cooled liquid portion at a first feed point and to separate said relatively less volatile fraction; and (e) a second expansion means connected to said cooling means (a) to receive feed gas vapor therefrom and expand it to said lower pressure in a work-expansion engine, wherein work is extracted therefrom, said second expansion means being further connected to said fractionation column to supply at least part of the expanded feed gas vapor to said fractionation column, the improvement comprising means for turning back at least a portion of said feed gas vapor prior to expansion thereof, said turn-back means comprising (i) dividing means connected to said cooling means (a) to receive said feed gas vapor and to divide it into at least a first part and a second part;

(ii) heat exchange means connected to said dividing means (a) to receive the first part of said feed gas vapor, said heat exchange means being connected to reheat said first part of said feed gas vapor;

(iii) a third expansion means connected to said heat exchange means (ii) to receive said reheated portion of said feed gas vapor and to expand said reheated portion to said lower pressure while extracting work therefrom;

(iv) means connecting said third expansion means (iii) to said fractionation column (d) to supply the expanded reheated feed gas thereto at a second feed point, said second feed point being at a lower position on said fractionation column than said first feed point;

(v) heat exchange means connected to said dividing means (i) to receive said second part and to cool said second part;

(v) expansion means connected to said heat exchange means (v) to receive said cooled second part and to expand said cooled second part to said lower pressure; and (vii) means connecting said expansion means (vi) to said fractionation column to supply said expanded second part to said fractionation column at a feed point above said second feed point.

9. In an apparatus for the separation of a feed gas into a volatile residue gas and a relatively less volatile fraction, said feed gas containing hydrocarbons, methane and ethane together comprising a major portion of the feed gas, said apparatus having (a) cooling means for cooling said feed gas under pressure to partially condense said gas sufficiently to form a liquid portion and a feed gas vapor;

(b) sub-cooling means connected to said cooling means (a) to receive at least some of said liquid portion and to sub-cool it to a temperature below its bubble point;

(c) a first expansion means connected to said sub-cooling means to receive the sub-cooled liquid portion and to expand it to a lower pressure, whereby a part of said liquid portion vaporizes to cool the expanded sub-cooled liquid portion;

(d) a fractionation column connected to said first expansion means to receive at least part of the expanded sub-cooled liquid portion at a first feed point and to separate said relatively less volatile fraction; and (e) a second expansion means connected to said cooling means (a) to receive feed gas vapor therefrom and expand it to said lower pressure in a work-expansion engine, wherein work is extracted therefrom, said second expansion means being further connected to said fractionation column to supply at least part of the expanded feed gas vapor to said fractionation column, the improvement comprising means for turning back at least a portion of said feed gas vapor prior to expansion thereof, said turn-back means comprising (i) heat exchange means connected to said cooling means (a) to receive at least a portion of said feed gas vapor, said heat exchange means being connected to reheat said portion of said feed gas vapor;

(ii) a third expansion means connected to said heat exchange means (i) to receive said reheated portion of said feed gas vapor and to expand said reheated portion to said lower pressure while extracting work therefrom;

(iii) heat exchange means connected to said expansion means (ii) to receive said expanded reheated portion;

(iv) means further connecting said heat exchange means (iii) to receive at least a portion of residue gas and to direct said residue gas into heat exchange relation with said expanded reheated portion, whereby said expanded reheated portion is cooled; and (v) means connecting said heat exchange means (iii) to said fractionation column to supply said cooled expanded reheated portion to said fractionation column at a second feed point, said second feed point being at a lower position on said fractionation column than said first feed point.

10. In a process for the separation of a feed gas into a volatile residue gas and a relatively less volatile fraction, said feed gas containing hydrocarbons, methane and ethane together comprising a major portion of the feed gas, wherein (1) said feed gas under pressure is cooled to partially condense said gas and to form thereby a liquid portion and a feed gas vapor;

(2) at least some of the liquid portion thereby obtained is cooled to a temperature below its bubble point;

(3) the liquid portion is expanded to a lower pressure, whereby a first part of the liquid portion vaporizes to cool the expanded liquid portion;

(4) at least part of said expanded liquid portion is thereafter supplied to a fractionation column at a first feed point, wherein said relatively less volatile fraction is separated;

(5) said feed gas vapor is expanded to said lower pressure in a work-expansion machine, wherein work is extracted therefrom; and (6) at least part of the expanded feed gas vapor is supplied to said fractionation column, the improvement comprising (a) dividing said feed gas vapor into a first part and a second part;

(b) combining said first part of the feed gas vapor with the liquid portion of said feed gas to form thereby a combined stream;

(c) cooling at least one of said first part of the feed gas vapor, liquid portion of the feed gas, and said combined stream, whereby the combined stream is cooled to a temperature below the bubbled point of said liquid portion;

(d) expanding said combined stream and supplying the expanded combined stream to said distillation column at said first feed point;

(e) directing at least a portion of said feed gas vapor into heat exchange relation with said feed gas under pressure, whereby said feed gas vapor is reheated;

(f) thereafter expanding the reheated second part of the feed gas vapor to said lower pressure while extracting work therefrom; and (g) supplying said expanded second part to said fractionation column at a second feed point, said second feed point being at a lower position on the fractionation column than said first feed point.

11. In a process for the separation of a feed gas into a volatile residue gas and a relatively less volatile fraction, said feed gas containing hydrocarbons, methane and ethane together comprising a major portion of the feed gas, wherein (1) said feed gas under pressure is cooled to partially condense said gas and to form thereby a liquid portion and a feed gas vapor;

(2) at least some of the liquid portion thereby obtained is subcooled to a temperature below its bubble point;

(3) the subcooled liquid portion is expanded to a lower pressure, whereby a first part of the liquid portion vaporizes to further cool the expanded liquid portion;

(4) at least part of said expanded liquid portion is thereafter supplied to a fractionation column at a first feed point, wherein said relatively less volatile fraction is separated;

(5) said feed gas vapor is expanded to said lower pressure in a work-expansion machine, wherein work is extracted therefrom; and (6) at least part of the expanded feed gas vapor is supplied to said fractionation column, the improvement comprising (a) dividing said feed gas vapor into a first part and a second part;

(b) reheating said first part of the feed gas vapor by directing it into heat exchange relation with said feed gas under pressure;

(c) expanding said reheated feed gas vapor to said lower pressure;

(d) supplying the reheated first part after expansion thereof to said fractionation column at a second feed point, said second feed point being below said first feed point; and (e) expanding the second part of said feed gas vapor to said lower pressure and supplying said expanded second part of the feed gas vapor to said fractionation column at a feed point above said second feed point.

12. In a process for the separation of a feed gas into a volatile residue gas and a relatively less volatile fraction, said feed gas containing hydrocarbons, methane and ethane together comprising a major portion of the feed gas, wherein (1) said feed gas under pressure is cooled to partially condense said gas and to form thereby a liquid portion and a feed gas vapor;

(2) at least some of the liquid portion thereby obtained is cooled to a temperature below its bubble point;

(3) the liquid portion is expanded to a lower pressure, whereby a first part of the liquid portion vaporizes to cool the expanded liquid portion;

(4) at least part of said expanded liquid portion is thereafter supplied to a fractionation column at a first feed point, wherein said relatively less volatile fraction is separated;

(59 said feed gas vapor is expanded to said lower pressure in a work-expansion machine, wherein work is extracted therefrom; and (6) at least part of the expanded feed gas vapor is supplied to said fractionation column, the improvement comprising (a) dividing said first feed gas vapor into a first part and a second part;

(b) directing said first part into heat exchange relation with said feed gas under pressure, whereby said first part of the said feed gas vapor is reheated;

(c) expanding said first part of the feed gas vapor and thereafter suppying the expanded first part to said fractionation column at a second feed point, said second feed point being at a lower column position than said first feed point;

(d) cooling said second part of the feed gas vapor;

(e) expanding the second part of said feed gas vapor to said lower pressure; and (f) supplying said expanded second part to said fractionation column at a feed point above said second feed point.

13. In a process for the separation of a feed gas into a volatile residue gas and a relatively less volatile fraction, said feed gas containing hydrocarbons, methane and ethane together comprising a major portion of the feed gas, wherein (1) said feed gas under pressure is cooled to partially condense said gas and to form thereby a liquid portion and a feed gas vapor;

(2) at least some of the liquid portion thereby obtained is cooled to a temperature below its bubble point;

(3) the liquid portion is expanded to a lower pressure, whereby a first part of the liquid portion vaporizes to cool the expanded liquid portion;

(4) at least part of said expanded liquid portion is thereafter supplied to a fractionation column at a first feed point, wherein said relatively less volatile fraction is separated;

(5) said feed gas vapor is expanded to said lower pressure in a work-expansion machine, wherein work is extracted therefrom; and (6) at least part of the expanded feed gas vapor is supplied to said fractionation column, the improvement comprising (a) reheating at least some of the feed gas vapor prior to expansion thereof;

(b) expanding said reheated feed gas vapor in a work-expansion machine to said lower pressure, whereby work is extracted therefrom;

(c) directing said expanded feed gas vapor portion into heat exchange relation with residue gas from said fractionation column, wherein the expanded feed gas vapor is further cooled; and (d) thereafter supplying said further cooled expanded feed gas vapor to said fractionation column at a second feed point, said second feed point being at a lower column position than said first feed point.

14. In a process for the separation of a feed gas into a volatile residue gas and a relatively less volatile fraction, said feed gas containing hydrocarbons, methane and ethane together comprising a major portion of the feed gas, wherein (1) said feed gas under pressure is cooled to partially condense said gas and to form thereby a liquid portion and a feed gas vapor;

(2) at least some of the liquid portion thereby obtained is cooled to a temperature below its bubble point;

(3) the liquid portion is expanded to a lower pressure, whereby a first part of the liquid portion vaporizes to cool the expanded liquid portion;

(4) at least part of said expanded liquid portion is thereafter supplied to a fractionation column at a first feed point, wherein said relatively less volatile fraction is separated;

(5) said feed gas vapor is expanded to said lower pressure in a work-expansion machine, wherein work is extracted therefrom; and (6) at least part of the expanded feed gas vapor is supplied to said fractionation column, the improvement comprising (a) dividing said feed gas vapor into a first part and a second part;

(b) expanding said first part of the feed gas vapor to said lower pressure and supplying the expanded first part to said fractionation column;

(c) directing the second part of said feed gas vapor into heat exchange relation with said feed gas under pressure, whereby said second part of the feed gas vapor is reheated;

(d) expanding the second part of said feed gas vapor to said lower pressure in a work-expansion machine, thereby extracting work therefrom; and (e) thereafter supplying said expanded second part to said fractionation column at a second feed point, said second feed point being at a lower column position than said first feed point.

15. The improvement according to claim 14, wherein said liquid portion is subcooled by directing it into heat exchange relation with at least a portion of said residue gas from said fractionation column.

16. The improvement according to claim 14, wherein said expanded second part of the feed gas vapor is directed into heat exchange relation with at least a portion of the residue gas, thereby to further cool said expanded second part prior to supplying it to the fractionation column at the second feed point.

* * * * *

UNITED STATES PATENT OFFICE

CERTIFICATE OF CORRECTION

Patent No. 4,140,504 Dated February 20, 1979

Inventor(s) Roy E. Campbell and John D. Wilkinson

It is certified that error appears in the above-identified patent and that said Letters Patent are hereby corrected as shown below:

Col. 3, line 35, "728,962" should read --728,963--;
Col. 9, line 7, "recovered," should read --recovered.--;
Col. 11, line 66, "728,962" should read --728,963--;
Col. 16, line 48, "meas" should read --means--;
Col. 17, line 9, "no" should read --to--;
Col. 21, line 46, "(v)" should read --(vi)--;
Col. 23, line 2, "the improve-" should start a new line;
Col. 23, line 12, "bubbled" should read --bubble--;
Col. 24, line 26, "the improve-" should start a new line; and
Col. 24, line 35, "suppying" should read --supplying--.

Signed and Sealed this

Eighth Day of July 1980

[SEAL]

Attest:

SIDNEY A. DIAMOND

Attesting Officer

Commissioner of Patents and Trademarks